US007704154B2

(12) United States Patent
Loh et al.

(10) Patent No.: US 7,704,154 B2
(45) Date of Patent: Apr. 27, 2010

(54) GOLF SWING TRAINER

(76) Inventors: Cheng Wah Loh, 8818 Emperor Ave., Los Angeles, CA (US) 91775; Yini Wu, 970 Medford Rd., Pasadena, CA (US) 91107

( * ) Notice: Subject to any disclaimer, the term of this patent is extended or adjusted under 35 U.S.C. 154(b) by 0 days.

(21) Appl. No.: 12/319,202

(22) Filed: Jan. 2, 2009

(65) Prior Publication Data

US 2009/0176594 A1 Jul. 9, 2009

Related U.S. Application Data

(60) Provisional application No. 61/070,959, filed on Mar. 27, 2008, provisional application No. 61/010,375, filed on Jan. 9, 2008, provisional application No. 61/125,412, filed on Apr. 25, 2008, provisional application No. 61/072,783, filed on Apr. 3, 2008, provisional application No. 61/062,856, filed on Jan. 30, 2008.

(51) Int. Cl.
*A63B 69/36* (2006.01)

(52) U.S. Cl. ..... 473/221; 473/148; 473/219

(58) Field of Classification Search ..... 473/139, 473/140, 147, 148, 151, 198, 219, 221, 222, 473/225

See application file for complete search history.

(56) References Cited

U.S. PATENT DOCUMENTS

| | | | | |
|---|---|---|---|---|
| 3,601,408 | A * | 8/1971 | Wright | 473/225 |
| 4,254,956 | A * | 3/1981 | Rusnak | 473/225 |
| 5,976,022 | A * | 11/1999 | Williams | 473/151 |
| 6,227,984 | B1 * | 5/2001 | Blankenship | 473/221 |
| 6,554,716 | B1 * | 4/2003 | Loh et al. | 473/148 |
| 6,821,211 | B2 * | 11/2004 | Otten et al. | 473/219 |

* cited by examiner

*Primary Examiner*—Nini Legesse
(74) *Attorney, Agent, or Firm*—Clement Cheng

(57) ABSTRACT

A golf swing modeling device includes a base having a first row of sensors, a striking row of sensors, a second row of sensors and a third row of sensors. The various sensors output individual signals. The striking row of sensors comprises a striking row inside sensor and a striking row outside sensor. A ball striking assembly has a lower ball mounted on a lower ball arm which is mounted on a lower retainer and an upper ball mounted on an upper ball arm which is mounted on an upper retainer. The upper ball has a sensor which outputs a signal when struck. A striking face of the lower ball is placed between the striking row inside sensor and striking row outside sensor. A processor receives individual signals from the sensors. The processor calculates club speed, and club head orientation from individual signals, and the processor provides output.

6 Claims, 10 Drawing Sheets

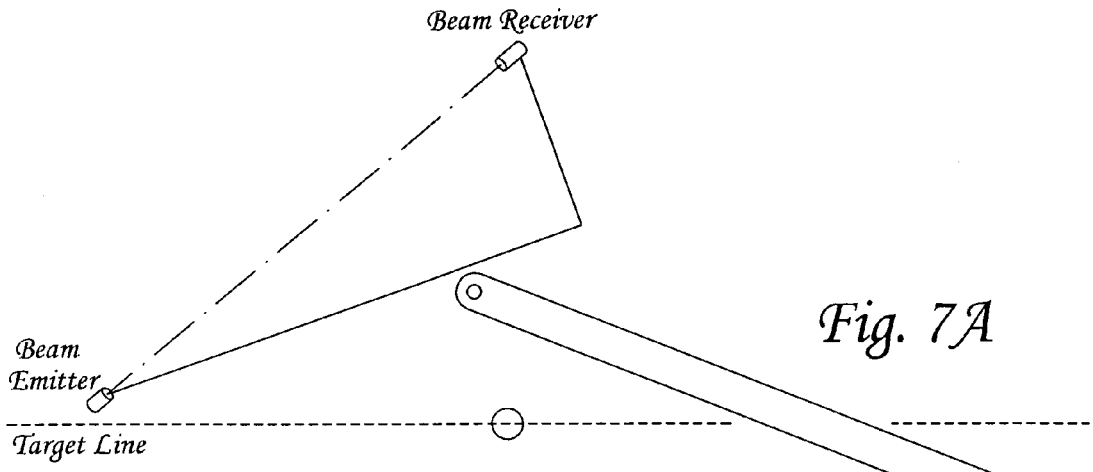
Fig. 7A
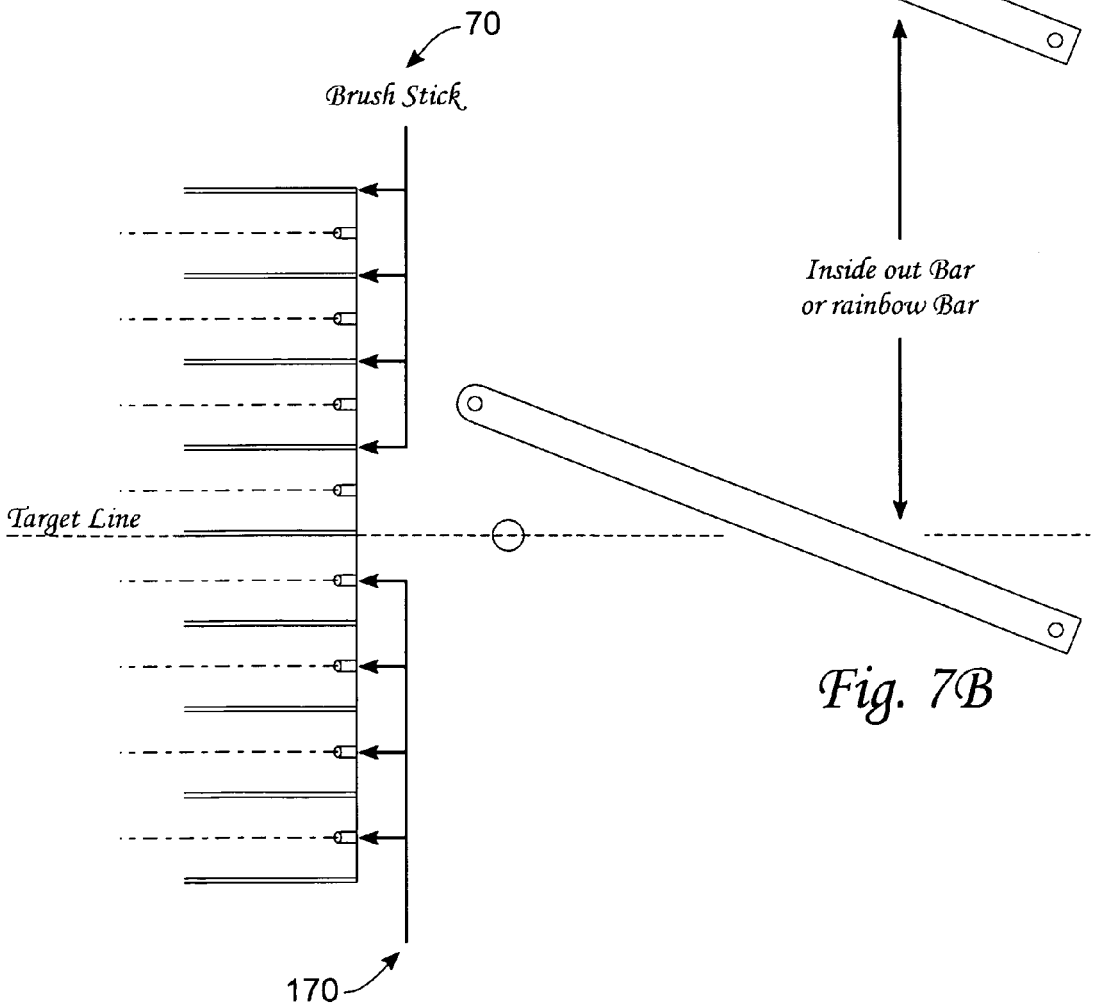
Fig. 7B
Fig. 7

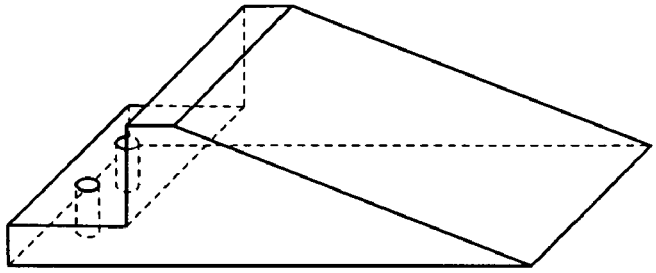
Fig. 8A
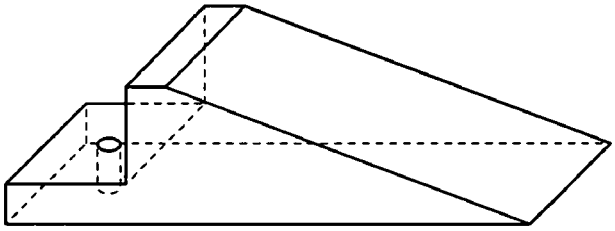
Fig. 8B
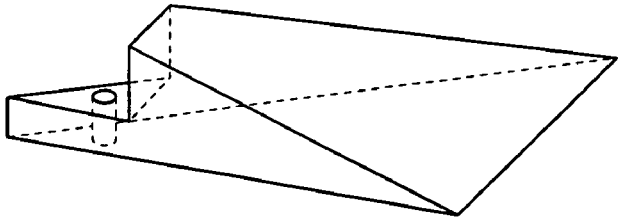
Fig. 8C
Fig. 8

Coil Spring
Elastic Stick
Brush Material
Elastic Stick
Coil Spring
Elastic Stick
Cylinder
Cone
Threaded Cylinder Fig. 10A
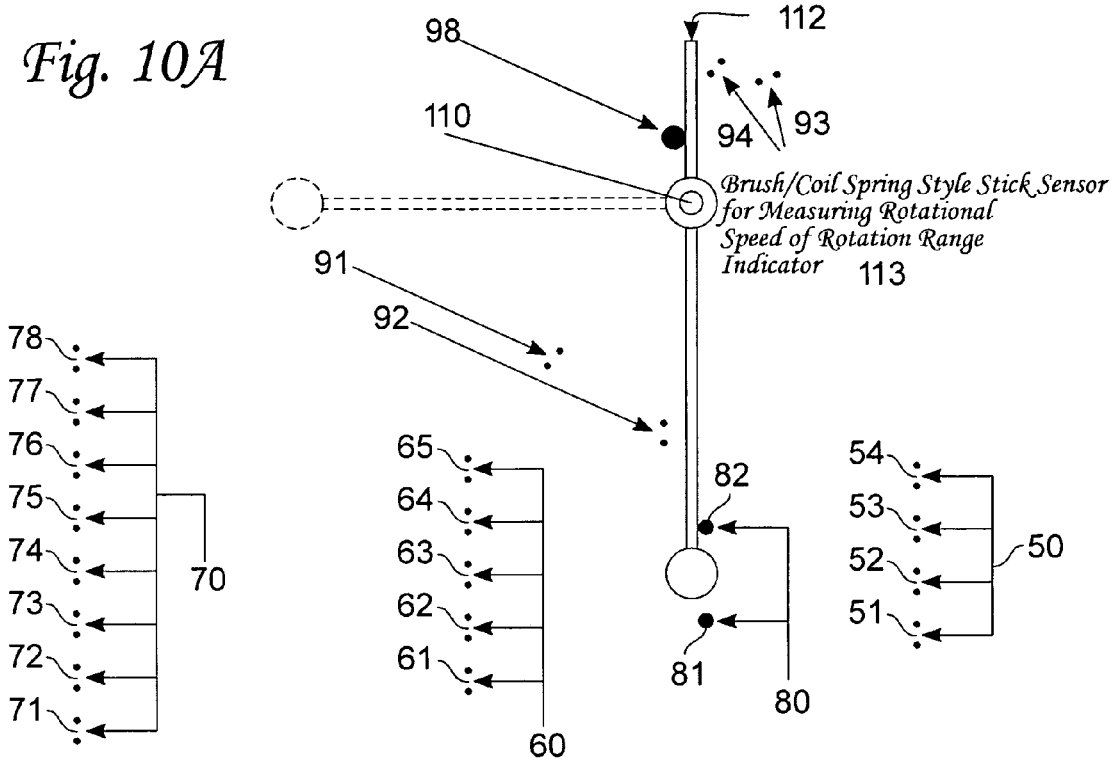
Fig. 10B
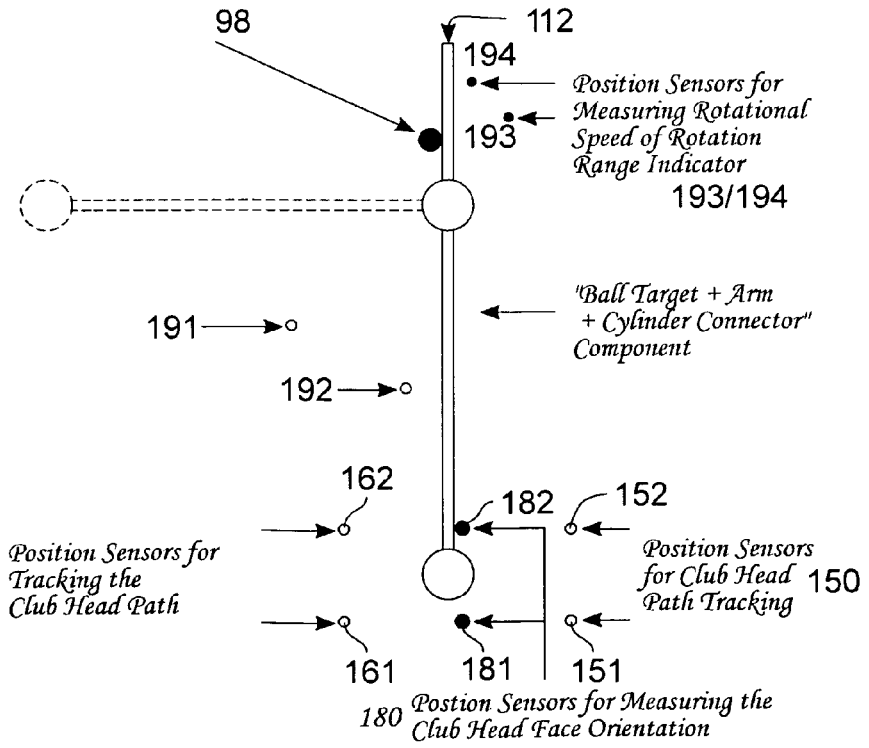
Fig. 10

GOLF SWING TRAINER

This application claims priority from U.S. patent application Ser. No. 11/895,662 for a Golf Swing Trainer filed Aug. 27, 2007 the disclosure of which is incorporated herein by reference, which further claims domestic priority from provisional application 60/843,777 for a Golf Swing Trainer having a filing date of Sep. 11, 2006 the disclosure of which is incorporated herein by reference. The application claims priority from provisional application 61/070,959 filed Mar. 27, 2008 entitled Golf Follow Through Guide. The application claims priority from provisional application 61/010,375 filed Jan. 9, 2008. The application further claims priority from provisional application 61/125,412 filed Apr. 25, 2008 and provisional application 61/072,783 filed Apr. 3, 2008 and provisional application 61/062,856 filed Jan. 30, 2008.

BACKGROUND OF THE INVENTION

1. Field of the Invention

This invention relates generally to a golf training, practice, and coaching device.

2. Discussion of Related Art

A variety of golf assistance devices had been invented. For example, Golf 'Swing For Accuracy' Mat U.S. Pat. No. 6,554,716 patented Apr. 29, 2003 shows a device having a mat and a pair of connecting arms holding ball targets that assist the user in improving a golf swing. The disclosure of U.S. Pat. No. 6,554,716 is incorporated herein by reference.

Additionally, a variety of motion sensing contraptions have been devised for golf training purposes. Some golf swing sensing devices have tracked a golf ball for determining and analyzing swing characteristics. These golf swing sensing devices with golf ball tracking allow virtual display of a golf ball flight path for allowing indoor golf simulation and golf practice.

A variety of golf simulation games have been created for virtual golf indoor simulation. However, the mechanical input apparatus has not been as advanced as the improvements in graphics and golf ball flight calculation. Currently, given the input, golf simulation can calculate flight of a golf ball accounting for many factors such as spin, initial velocity, club head speed, golf ball type, and wind. Unfortunately, the mechanical input apparatus has been lacking. Some systems use a tracking device for tracking the initial path of a golf ball to determine initial velocity, and direction. These systems, while they provide an excellent processing of input information, do not fare well in accounting for the ball spin and club face impact angle. So while algorithms are well developed based on fundamental physics, development of a mechanical input apparatus has been lacking in comparison.

SUMMARY OF THE INVENTION

The invention is an input apparatus for analyzing a golf swing. The major parts of the apparatus include a microprocessor, a ball for striking, an upper ball placed above the striking ball, and three or more swing sensors. The swing sensors detect the path of the golf club travel, the rotational speed of the striking ball, and also detect the golf club face orientation during impact. The position sensors, working together, detect the path and position of the club head. The microprocessor takes the information given by the sensors and processes the information using commonly available golf ball algorithms and sends the information to a display. The goal of the user is to find the perfect curve through practice on the driving range. The apparatus may be used in conjunction with the device of U.S. Pat. No. 6,554,716, the disclosure of which is incorporated herein by reference.

The device consists in general of an orientation sensor, some position sensors and a couple of movable balls. A special movable elastic plastic portion has an upper ball having the same function as a ball holding plate and ball holding arm and ball holding cylinder connector components similar to the ball holding component in U.S. Pat. No. 6,554,716 entitled "Swing For Accuracy". The present invention includes a movable hollow cylinder connector attached to the ball holding plate and ball holding arm to allow the ball holder to move up and down vertically inside the block.

Multiple position sensors are placed on both sides of the golf ball which is on the tee at a user adjusted position. These position sensors and the golf ball may form a line connecting the target to the golf ball to form a target line. The sensors are also positioned so that when the club head passes along the target line.

A variety of stick sensors act as position sensors and direction sensors. The stick sensors are numerous and oriented in an array such that each stick is a bristle of a brush. The stick sensors have an electronic pickup on the base to provide stroke input to the processor. The stick sensors are preferably mounted in slots to provide a more linear range of motion. Each stick sensor has a base electronic pickup which is wired to the processor. The slots are preferably rectangular. A first array of sticks, preferably a total of four sticks are mounted ahead of the ball. A second array of sticks preferably mounted behind the ball preferably provides a total of five sticks for measuring club action and speed. The club action is calculated by determining the time between contacting each stick. For example, the speed of the club is calculated by determining the time between the first stick sensor pickup activation and the second stick sensor pickup activation. The angle of the club can be determined by comparing the time between stick sensor pickup activation on the same array. For example, the angle of the club can be determined by comparing the first stick sensor pickup activation, the second stick sensor pickup activation, and the third stick sensor pickup activation or the last stick sensor pickup activation.

The stick sensors optionally have spring connection at a lower end. Optionally, the stick sensor can be made in a triple bristle configuration where a few bristles protrude from the stick base. After the microprocessor receives the information from the pickup, the microprocessor can calculate the type of swing. The swing parameters may then be output to a display, such as a bank of LED lights, or the output can be received by a video game golf simulator for calculating ball physics in the game.

OBJECTS OF THE INVENTION

The object of the invention is to provide an improved golf swing trainer.

BRIEF DESCRIPTION OF THE DRAWINGS

FIG. 6A-FIG. 6C are diagrams of the striking row sensor configuration.

FIG. 6Ai is a perspective view of the stick sensor configuration before a pure strike.

FIG. 6Aii is a top view of the electronic sensor configuration before a pure strike.

FIG. 6Aiii is a top view of the stick sensor configuration after a pure strike.

FIG. 6 Bii is a top view of the electronic sensor configuration before a stroke causing a slice.

FIG. 6 Biii is a top view of the stick sensor configuration after a stroke causing a slice.

FIG. 6 Ci is a perspective view of the stick sensor configuration before a stroke causing a hook.

FIG. 6 Cii is a top view of the striking row sensor configuration before a stroke causing a hook.

FIG. 6 Ciii is a top view of the striking row sensor configuration after a stroke causing a hook.

FIG. 7*a* is a diagram of the components for using the rainbow bar and emitter receiver through beam sensor with protective slope in relation to the target line.

FIG. 7*b* is a diagram of the components for using the rainbow bar with the third row of stick sensors and electronic position sensors behind the protective slope.

FIG. 8A is a diagram of the third row of sticks sensors with two sockets behind the protective slope.

FIG. 8B is a diagram of the third row of sticks sensors with one socket behind the protective slope.

FIG. 8C is a diagram of the third row of sticks sensors with one socket behind the protective slope.

FIG. 10 shows a variety of top views of sensor configurations.

FIG. 10A shows a variety of top views of stick sensor configurations.

FIG. 10B shows a variety of top views of the electronic beam sensor configurations.

Because of the large number of callout elements, a list of callout elements is provided for user reference as follows:

Lower Ball 21
First Row Of Stick Sensors 50
First Row First Stick Sensor 51
First Row Second Stick Sensor 52
First Row Third Stick Sensor 53
First Row Fourth Stick Sensor 54
Second Row Of Stick Sensors 60
Second Row First Stick Sensor 61
Second Row First Slot 361
Second Row Second Stick Sensor 62
Second Row Second Slot 362
Second Row Third Stick Sensor 63
Second Row Third Slot 363
Second Row Fourth Stick Sensor 64
Second Row Fourth Slot 364
Second Row Fifth Stick Sensor 65
Second Row Fifth Slot 365
Second Row Empty Slot 366
Second Row Last Slot 367
Second Row Slots 388
Third Row Of Stick Sensors 70
Third Row Sockets 370
Third Row First Stick Sensor 71
Third Row First Socket 371
Third Row Second Stick Sensor 72
Third Row Second Socket 372
Third Row Third Stick Sensor 73
Third Row Third Socket 373
Third Row Fourth Stick Sensor 74
Third Row Fourth Socket 374
Third Row Fifth Stick Sensor 75
Third Row Fifth Socket 375
Third Row Sixth Stick Sensor 76
Third Row Sixth Socket 376
Third Row Seventh Stick Sensor 77
Third Row Seventh Socket 377
Third Row Eighth Stick Sensor 78
Third Row Eighth Socket 378
Striking Row 80
Striking Row Inside Stick Sensor 81
Striking Row Outside Stick Sensor 82
Upper Ball 31
Upper Ball Arm 32
Upper Ball Retainer 210
Upper Threaded Opening 212
Set Screw 211
Shaft Axis 110
Helical Spring 230
Lower Ball Retainer 220
Lower Ball 21
Lower Ball Arm 22
Spring Receiving Opening 229
Spring Retaining Thread 228
Spring Retainer Set Screw 227
Lower Threaded Opening 224
Pin 223
Retainer Spring 222
Lower Set Screw 221
Threaded Mounting 225
Horizontal Stop Bar 226
Bottom Retainer 240
Lower Spring Opening 243
Bottom Spring Set Screw 244
Bottom Retainer Set Screw 241
Bottom Retainer Set Screw Thread 242
Ball Striking Assembly Base 245
Base 40
Higher Flat Surface 41
Inclining Surface 42
Lower Surface 43
Supporting Ball Device 2
Block 10
Slot 11
Bulbous End 111
Rotation Stopper 98
First Rotational Stick Sensor 91
Second Rotational Stick Sensor 92
Third Rotational Stick Sensor 93
Fourth Rotational Stick Sensor 94
First Electronic Position Sensor 191
Second Electronic Position Sensor 192
Third Electronic Position Sensor 193
Fourth Electronic Position Sensor 194
Striking Row Inside Position Sensor 181
Striking Row Outside Position Sensor 182
First Row Position Sensors 150

First Row Inside Position Sensor 151
First Row Outside Position Sensor 152
Second Row Inside Position Sensor 161
Second Row Outside Position Sensor 162

DETAILED DESCRIPTION OF THE PREFERRED EMBODIMENT

Figure 1:
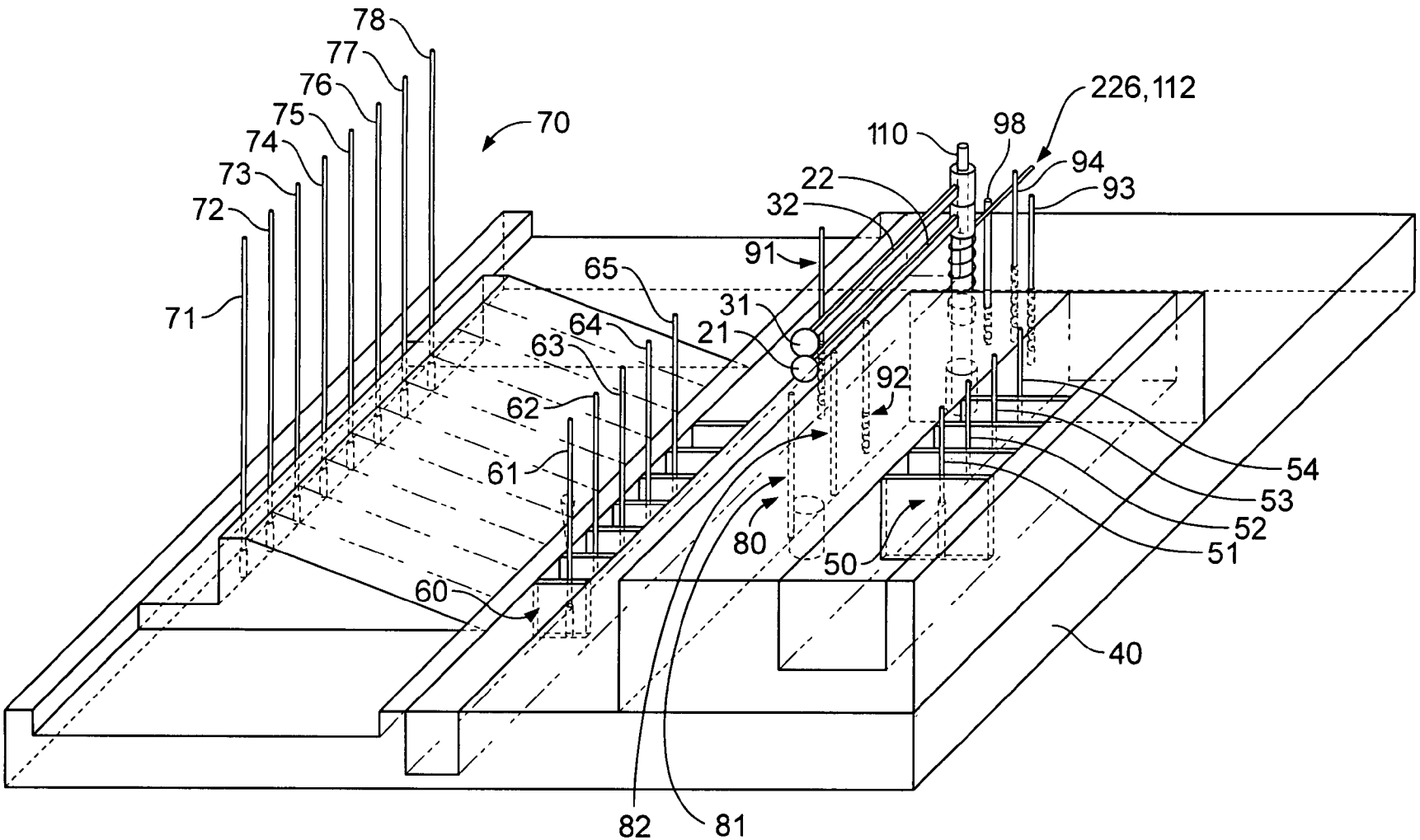
FIG. 1 is an isometric view of the present invention.

The present invention utilizes stick sensors which are arranged in arrays or rows. As seen in FIG. 1, the first row 50 is comprised of a first row first stick sensor 51, a first row second stick sensor 52, a first row third stick sensor 53, and a first row fourth stick sensor 54. The next row of stick sensors is preferably the striking row 80 which are mounted in collinear configuration with the front edge of the lower ball 21. The striking row 80 has a striking row inside stick sensor 81 to the left side of the lower ball 21 and a striking row outside stick sensor 82 to the right of the lower ball 21. The second row of stick sensors 60 includes a second row first stick sensor 61, a second row second stick sensor 62, a second row third stick sensor 63, a second row fourth stick sensor 64, and a second row fifth stick sensor 65. The third row of stick sensors 70 includes a third row first stick sensor 71, a third row second stick sensor 72, a third row third stick sensor 73, a third row fourth stick sensor 74, a third row fifth stick sensor 75, a third row sixth stick sensor 76, a third row seventh stick sensor 77, and finally an third row eighth stick sensor 78. Therefore, a total of four rows are implemented for recovering data on club speed, club path and club orientation.

Figure 3:
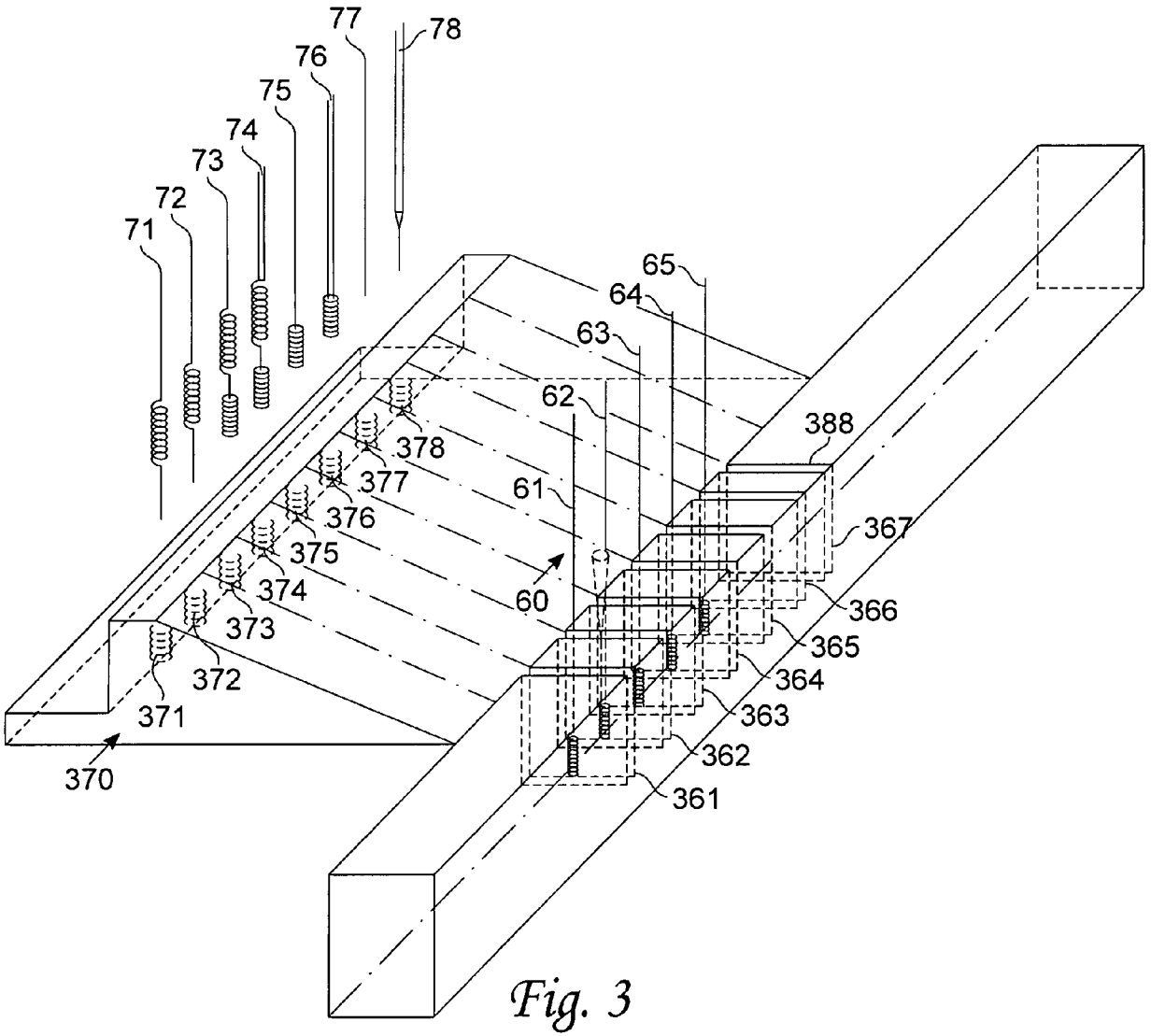
FIG. 3 is a diagram of two arrays of stick sensors.

The stick sensors are mounted within slots. For example, as seen in FIG. 3, the second row of stick sensors 60 have stick sensors mounted within slots. The second row first stick sensor 61 is mounted within a second row first slot 361. The second row second stick sensor 62 is mounted within the second row second slot 362. The second row third stick sensor 63 is mounted within the second row third slot 363. The second row fourth stick sensor 64 is mounted within the second row fourth slot 364. The second row fifth stick sensor 65 is mounted within the second row fifth slot 365. An empty second row slot 366 may optionally receive a beam sensor. The last second row slot 367 optionally allows a cone shaped sensor. The beam sensor and the cone shaped sensor may both receive a signal when activated for detecting club head path. The plurality of second row slots 388 are preferably aligned in a row such that regular interval spacing provides a uniform configuration.

Also shown in FIG. 3 are third row sockets for receiving stick sensors. The third row sockets 370 include the third row first socket 371, the third row second socket 372, the third row third socket 373, the third row fourth socket 374, the third row fifth socket 375, the third row sixth socket 376, the third row seventh socket 377, and the third row eighth socket 378.

Figure 2:
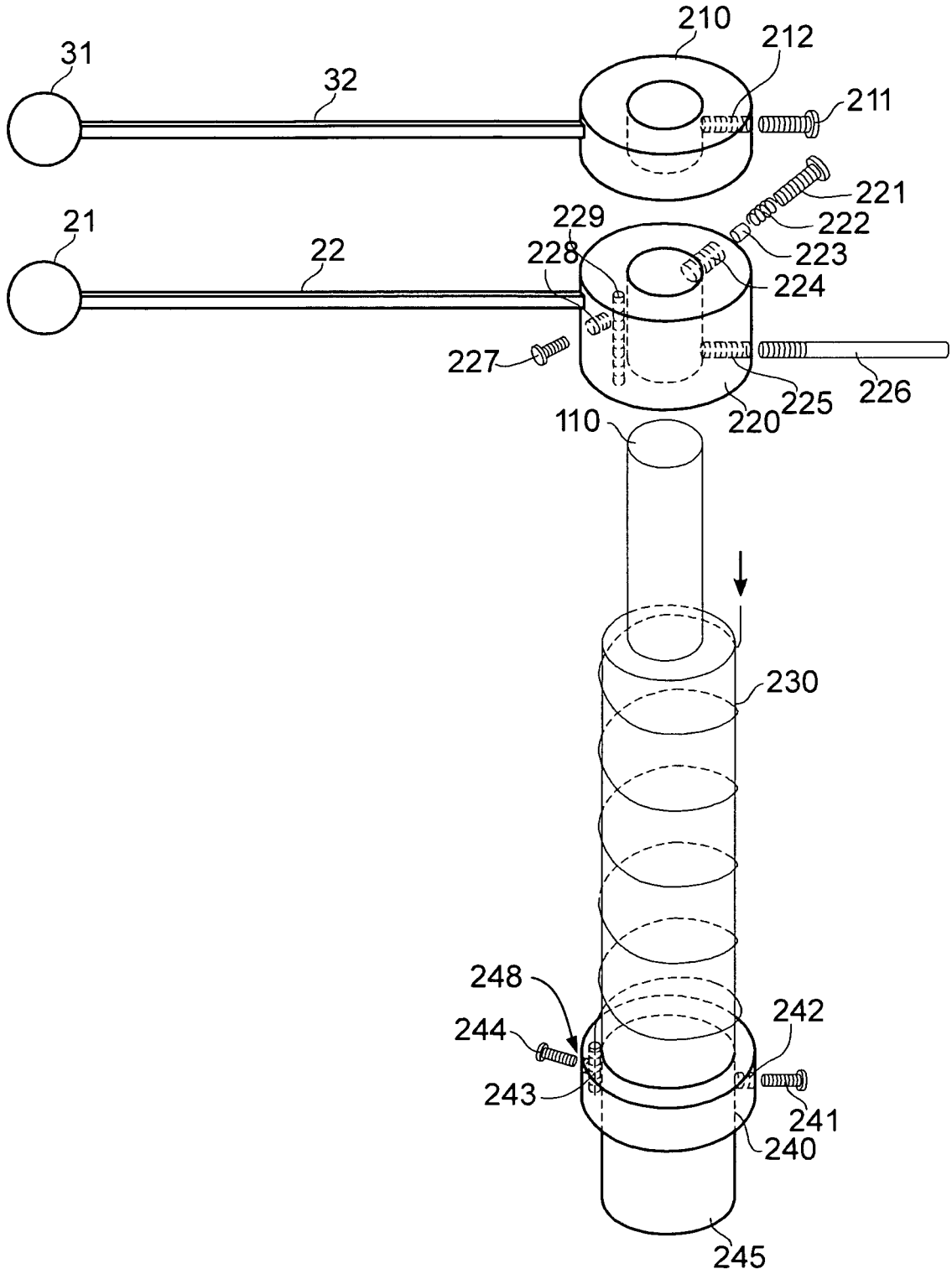
FIG. 2 is a diagram of components for the lower ball and upper ball assembly.

The ball striking assembly as a configuration that includes an upper ball 31 mounted on an upper ball arm 32 which in turn is mounted to an upper ball retainer 210, FIG. 2. The upper ball retainer 210 assumes the shape of a bearing which has an upper threaded opening 212 for receiving a set screw 211. The set screw has adjustable securing of the upper ball retainer 210 to the shaft axis 110. The shaft axis 110 has a helical spring 230 mounted around. The helical spring has an upper end denoted by an arrow. The upper end of the helical spring is connected to the lower ball retainer 220. The lower ball 21 is mounted on the lower ball arm 22 which is in turn mounted to the lower ball retainer 220. The lower ball retainer 220 may have an upper spring receiving opening 229 vertically disposed for receiving the vertically disposed upper end of the helical spring 230. The vertically disposed upper spring receiving opening 229 may have a spring retaining thread 228 receiving a spring retainer set screw 227. When spring retainer set screw 227 is engaged, it locks to the vertically disposed upper spring receiving opening 229 and retains the upper vertical portion of the helical spring 230. When the ball striking assembly is assembled, the helical spring biases the lower ball into a restored position for multiple strokes. The helical spring may further support the upper ball retainer 210 and the lower ball retainer 220 to maintain the lower ball in striking position. The lower ball retainer 220 may further have a lower threaded opening 224 for receiving a pin 223 and a retainer spring 222 with a lower set screw 221. The lower ball retainer may also have a threaded mounting 225 for receiving a horizontal limit stop bar 226 which also operates as a rotational range indicator. The pin 223 may act as a braking pad instead of a set screw.

A bottom retainer 240 supports the helical spring 230. The helical spring 230 has a bottom end which protrudes downward vertically into lower spring opening 243. The lower spring opening 243 is vertically oriented and has a bottom spring set screw 244 (through threaded hole 248) securing the lower end of the helical spring 230 with the bottom retainer 240. Also, the bottom retainer 240 is secured to the shaft axis 110 by a bottom retainer set screw 241 passing through a bottom retainer set screw thread 242. The ball striking assembly base 245 is disposed as a cylinder for installing into a circular opening in the base 40. The above preferred embodiment of the ball striking assembly may not necessarily be the only possible embodiment.

Figure 4:
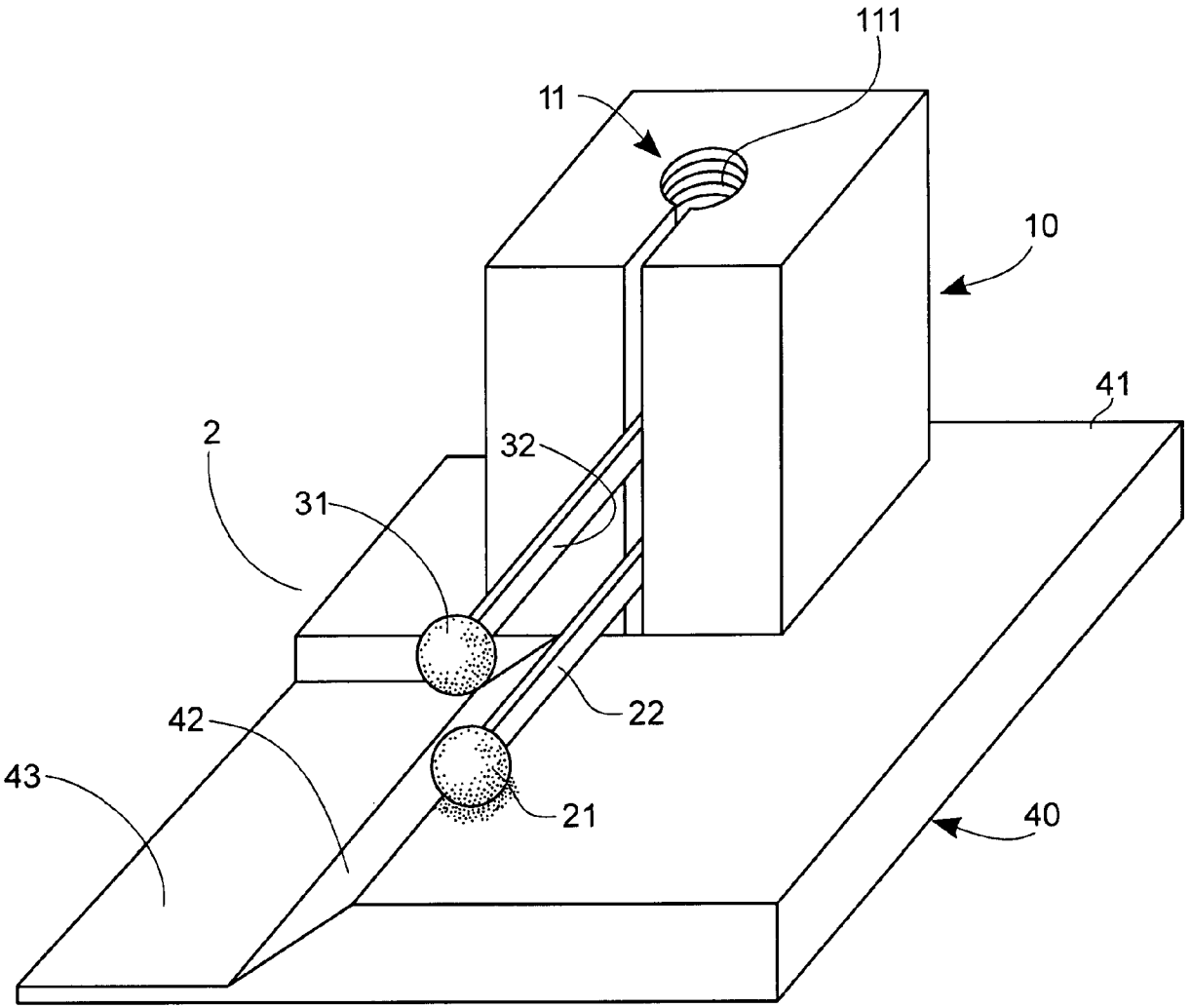
FIG. 4 is an alternate embodiment of the lower ball and upper ball assembly.

As an alternate embodiment of the ball striking assembly can be seen in FIG. 4, and also described in detail in U.S. Pat. No. 6,554,716 to Loh entitled Golf Swing For Accuracy Mat, the disclosure of which is incorporated herein in its entirety by reference. Generally, the alternative embodiment ball striking assembly includes a base 40 in the shape of a mat with a higher flat surface 41 and inclining surface 42 with a lower surface 43. The supporting ball device 2 can have a block 10 holding the practice arms within a slot 11. The slot may have a bulbous end 111. For further details relating to the invention, one may refer to the issued patent disclosure. Although the alternate embodiment provides an adequate ball striking assembly, the preferred embodiment should be used.

Figure 5:
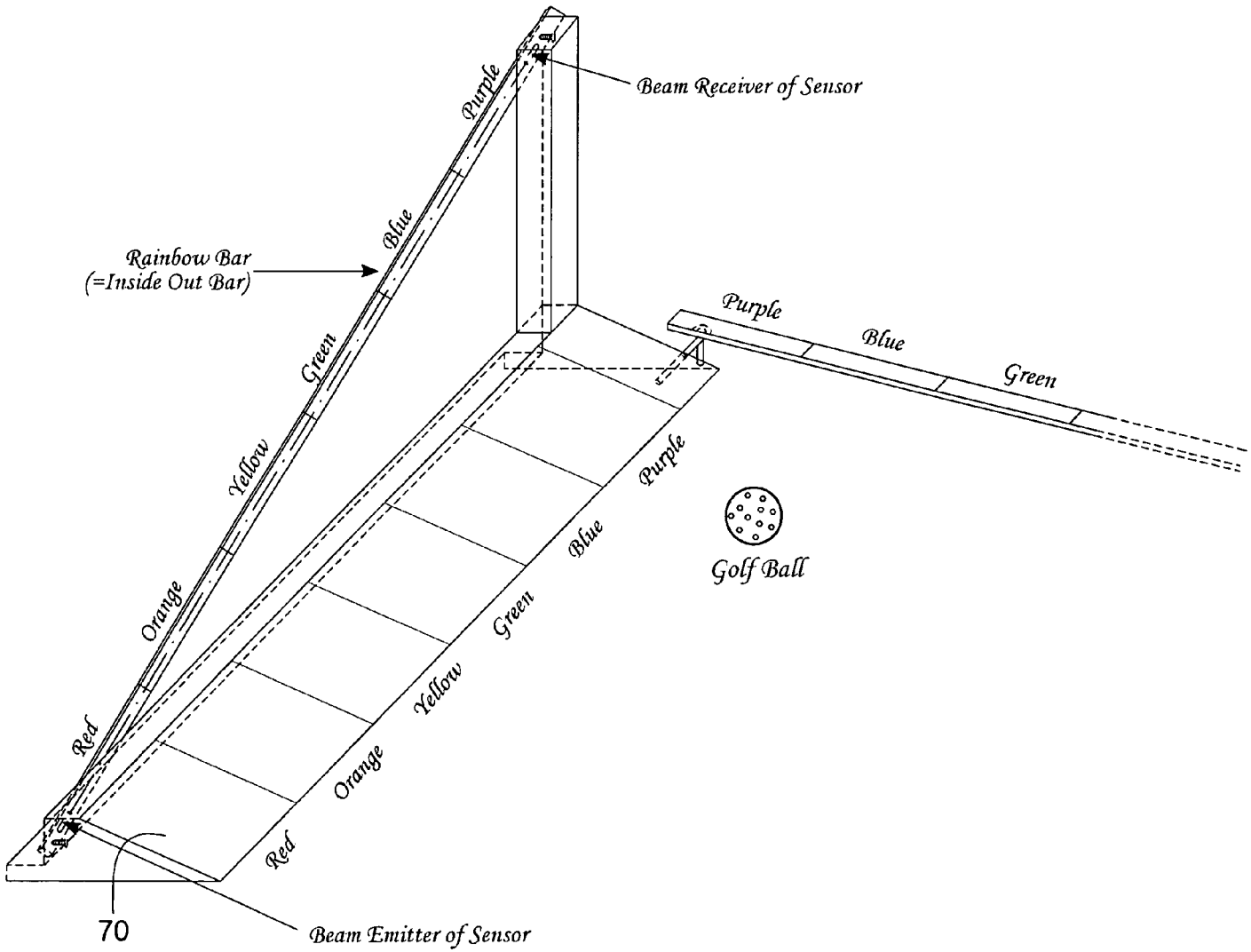
FIG. 5 is a diagram of the rainbow bar.

A helpful tool for beginners, FIG. 5, is a follow-through guide that may include a rainbow bar which is temporarily placed on a post. The rainbow bar preferably includes a red, orange, yellow, green, blue and purple band aligned with the similar color band on the protective slope surface. The rainbow bar has a lower end, and a higher end resting on a post to form an isosceles triangle. The protective slope surface has color bands of red, orange, yellow, green, blue and purple for coordinating visual association of the swing with the rainbow bar. When actually striking the ball, the bar is removed and placed to the side. A beam emitter and beam receiver provides a follow-through zone. The follow-through zone is defined by the isosceles right triangle configuration. When a user swings through, the user associates the color of the bar, and the color of the band on protective slope surface with user muscle memory. The follow-through guide further includes an audible feedback for receiving immediate feedback. A speaker element can play a tone when the user follows through. The tone and color of the follow-through guide provide a reference for beginners. The rainbow bar tool can be used in conjunction with the ball striking assembly, or the other elements of the invention. The protective slope surface is preferably at the location of the third row of sensors which is about one and a half feet behind the striking row. The follow-through guide can also replace the third row of position sensors and provide only one musical note when the club head interrupts the beam from the emitter to the receiver. The other musical notes are provided by the triggered position sensors in the first row, striking and the second row to form a musical tune which characterizes the swing curve.

Figure 6:
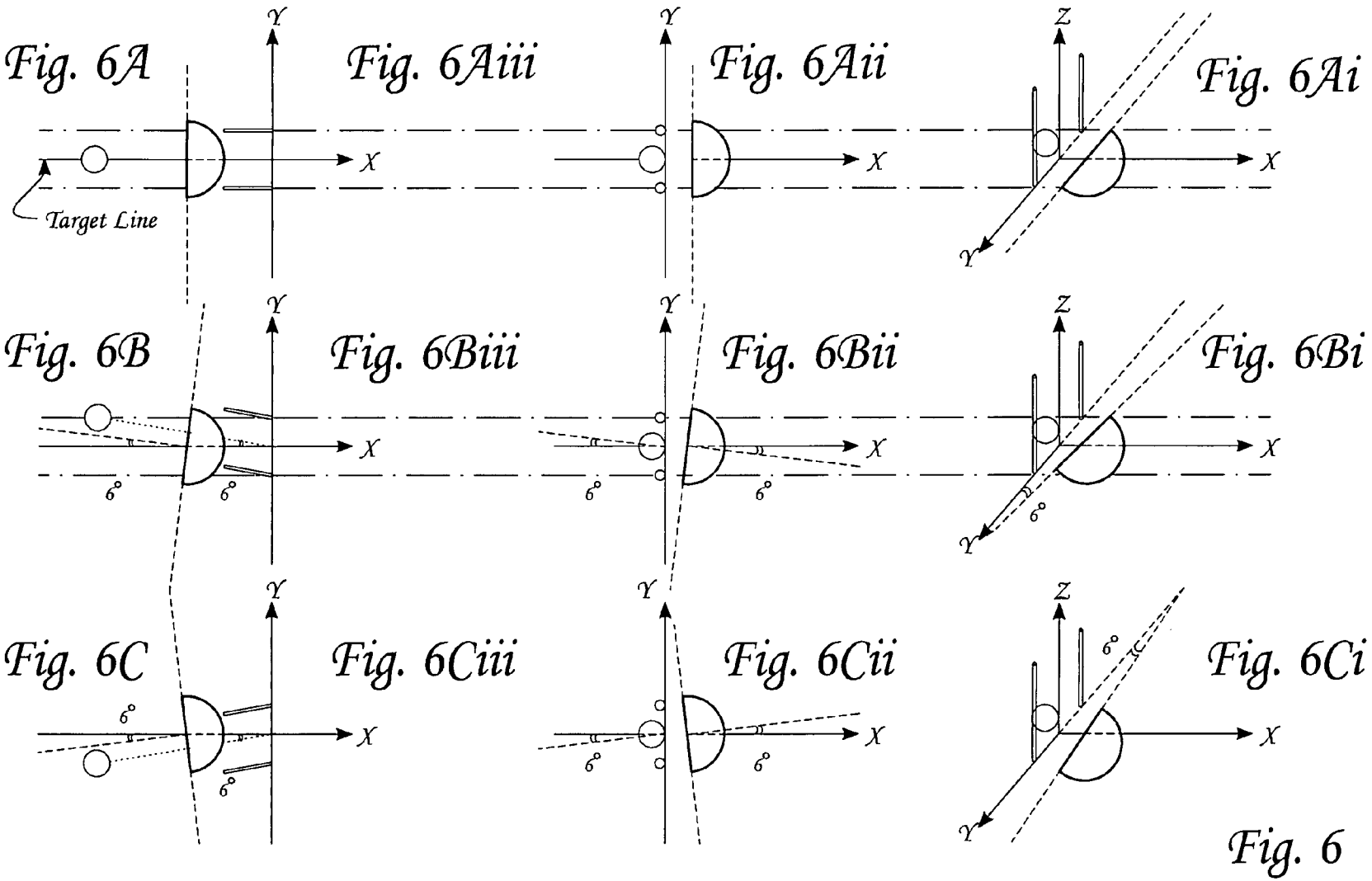
FIG. 6 Bi is a perspective view of the stick sensor configuration before a stroke causing a slice.

The present invention provides a number of configurations for the striking row sensors. Preferably, a pair of sensors on the striking row, namely a left sensor and a right sensor provide information regarding the orientation of the clubface during the striking of the ball. FIG. 6 shows the club moving along the X-axis from the right side of the golf ball to the left side of the golf ball. The golf ball is sitting on the X-axis with its right tip above the origin of the coordinates. The X-axis is coinciding with the target line which connects the target to the golf ball. FIG. 6Ai is a perspective view of the stick sensor configuration before a pure strike. In this configuration, the pair of stick sensors register at the same time and send a signal showing that no time difference exists between the sensors. FIG. 6Aii is a top view of the electronic sensor configuration before a pure strike. The top view shows that the clubface is flush with the line formed between the sensors and the face of the ball. FIG. 6Aiii is a top view of the stick sensor configuration after a pure strike. The stick sensors are pushed downward and are parallel to the striking of the golf ball.

The pair of sensors on the striking row also detect an angular deviation which causes a slice if the user rotates the clubface so that it is not parallel to the stick sensor line. FIG. 6 Bi is a perspective view of the stick sensor configuration before a swing having a deviation causing a slice, hereafter abbreviated as and called a 'slice'. Here, the angle of the slice is approximately 6° from the line of club head travel. The club contracts the inside sensor before the outside sensor, assuming that a right-handed stroke is in progress. The processor compares the signal time between the first row of sensors and the striking row of sensors to calculate the club speed. The processor then compares the time difference between each sensor on the striking row to calculate the amount of angular aberration. FIG. 6 Bii is a top view of the electronic sensor configuration before a slice. The top view shows that a 6° slice is in progress. FIG. 6 Biii is a top view of the stick sensor configuration after a slice. The stick sensors can be oriented so that they remain prone after being struck. The stick sensors can then provide a user with a visual cue as to the degree of slice. The stick sensors can be mounted on a ball assembly joint so that they rotate freely at the base. The stick sensor ball assembly joint is underneath the top surface of the base 40 so that it is not struck by the club. Stick sensors can optionally be mounted so that they automatically restore to original position. Some stick sensors can be mounted to stay down and provide the user with a visual cue while other stick sensors can be mounted to automatically restore. It is preferred that the striking row stick sensors are mounted with a ball joint at their base so that they remain prone temporarily for user feedback. The ball joint on the base of the stick sensors further includes a biasing dimple for restoring the stick sensor back to perfectly vertical position. FIG. 6 Ci is a perspective view of the stick sensor configuration before a swing having an angular deviation causing a hook, hereafter abbreviated and called a 'hook'. In this situation, the hook contacts the outside stick sensor first, and the inside stick sensor second. FIG. 6 Cii is a top view of the striking row sensor configuration before a hook. The angle of the hook is shown as 6° and is in progress. FIG. 6 Ciii is a top view of the striking row sensor configuration after a hook. The preferred striking row stick sensors are mounted on a ball joint at their base to provide manual restoration after a user views the stick sensor position as a guide for determining the angle of hook. A user may thus have a visual cue for determining the amount of hook or slice. The visual cue is in conjunction with electronic feedback from data captured when each stick sensor is struck. The stick sensor produces an electronic output when struck. The processor can compare the times between the electronic outputs to calculate angular aberration. Thus, the user has angular aberration as well as the visual cue for reference in training stroke habits.

As an optional embodiment, the configuration of the beam emitter and the beam receiver can be made detachable so that they can be used separately and independently apart from the other elements of this invention. The follow-through guide placed at a proper spot between the golf ball and the target can help the golfer swing with the club head moving along an inside and out route around the golf ball. The club head can be moving as far as possible along the target line for longer follow through and consistently moving along the same route relative to the golf ball so that the trajectory of the golf ball is more consistent along the target without a slice or hook. In FIG. 7A, a user uses a rainbow bar also called an inside out bar for providing a visual cue. The user can use the colors on the bar to provide a visual cue for training a practice swing. The target line denotes the path of the club head during the practice swing. As the user makes an actual swing, the club head passes through the beam when a stroke is proper. The user can rotate the rainbow bar or move it before during or after the practice swing as the user sees fit.

The optional embodiment training technique can also be used with an alternating array of stick sensors 70 alternating between beam sensors 170, FIG. 7. The stick sensors can be formed as brushes with bristles. The beam sensors 170 and brush sensors can both provide visual and audible feedback immediately. The feedback can be visual with LED lights or audible with tones. Each of the beam sensors or brush sensors can provide a different tone. The tones may form musical notes such that striking of multiple sensors creates a chord or other musical melody which the user can then associate with muscle memory. The musical melody may be derived from a contact between the club head and the position sensors in the first row, striking row, second row, and third row.

As yet another optional embodiment as seen in FIG. 8, the base 40 can be miniaturized into a small wedge for backyard practice such as chipping practice. The small wedge may receive a row of rear brush sticks. The brush sticks are preferably made of a metal material having resilience. When the rear row of brush sticks is hit, each can be tuned to a different sound or light so that a user may associate the brush stick activation pattern with a stroke. The rear brush sticks are mounted on a spring to provide a follow-through confirmation. A single or plurality of circular aperture sockets receive the brush sticks. Optionally, a pair of protruding stakes secure the wedge to the ground. The wedge may have a rectangular footprint as shown in FIG. 8A, a slim rectangular footprint as shown in FIG. 8B or a triangular footprint as shown in FIG. 8A. The optional embodiment can be used once the user has improved. Eventually, it is preferred that the user may practice and develop to a consistent swing without need for practice apparatus aids.

Figures 9, 9A, 9B, 9C, 9D, 9E, 9F, 9G, 9H, 9I:
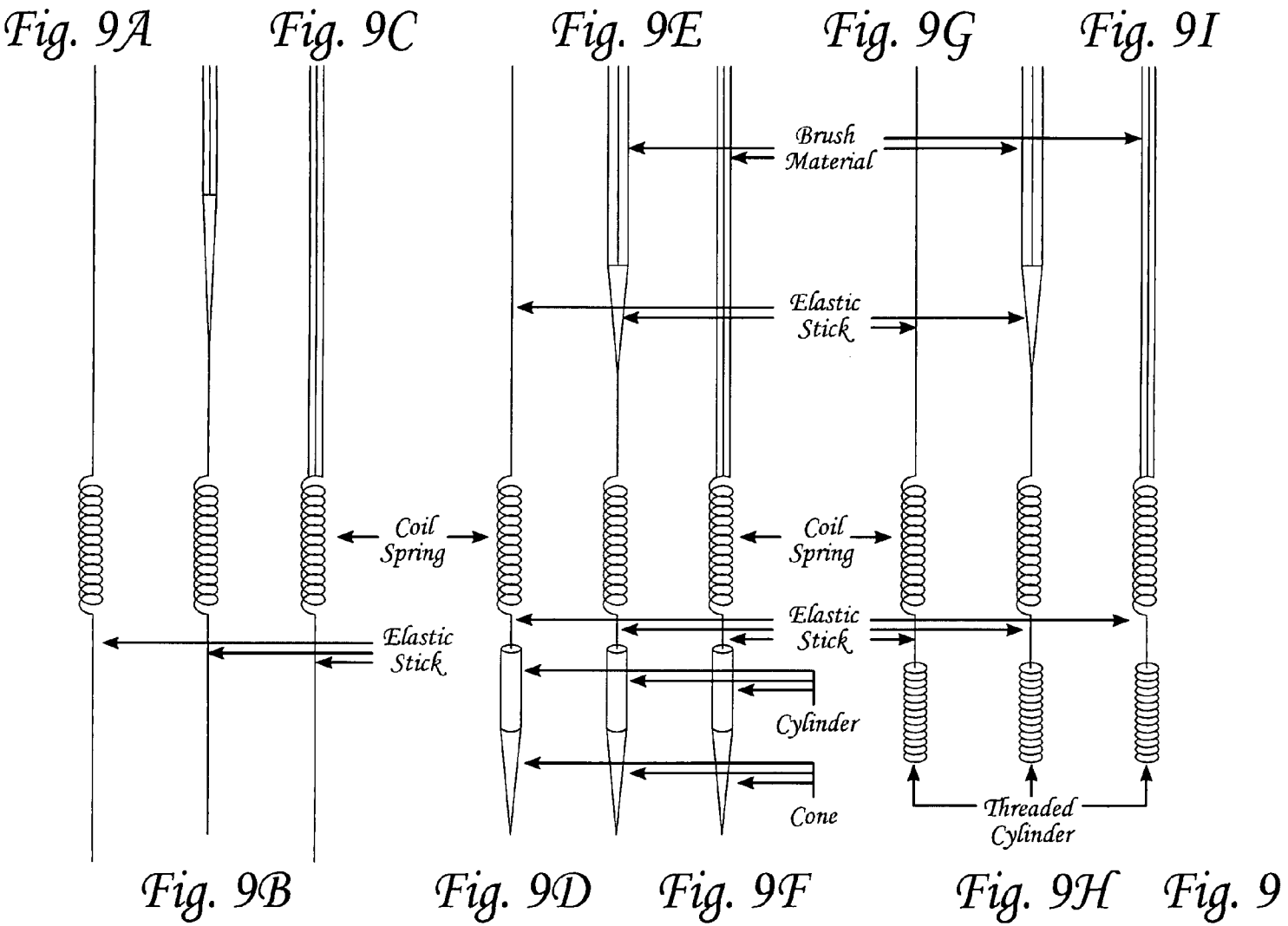
FIG. 9 shows different stick sensor configurations.
FIG. 9A is a diagram of a stick sensor configuration.
FIG. 9B is a diagram of a stick sensor configuration.
FIG. 9C is a diagram of a stick sensor configuration.
FIG. 9D is a diagram of a stick sensor configuration.
FIG. 9E is a diagram of a stick sensor configuration.
FIG. 9F is a diagram of a stick sensor configuration.
FIG. 9G is a diagram of a stick sensor configuration.
FIG. 9H is a diagram of a stick sensor configuration.
FIG. 9I is a diagram of a stick sensor configuration.

FIG. 9 shows different stick sensor configurations. FIG. 9A is a diagram of a stick sensor configuration which has an elastic stick bottom with a spring in the middle and a single bristle top. FIG. 9B is a diagram of a stick sensor configuration which has an elastic stick bottom with a coiled spring middle and a single bristle midsection which extends to a multiple bristle top. FIG. 9C is a diagram of a stick sensor configuration which has an elastic stick bottom with a coiled spring middle and a bristle stick top extending from the coiled spring middle. FIG. 9D is a diagram of a stick sensor configuration having a cone weighted bottom with a cylindrical base body above the cone weighted bottom and a coiled spring middle terminating in an elastic stick top. FIG. 9E is a diagram of a stick sensor configuration having a cylindrical base body above a cone weighted bottom with a coiled spring middle and brush bristle top with intermediate elastic stick. FIG. 9F is a diagram of a stick sensor configuration with a cone weighted bottom and a cylinder above the cone with an elastic stick intermediate portion and a coil spring middle terminating in brush material above. FIG. 9G is a diagram of a stick sensor configuration with a threaded cylinder bottom and elastic stick middle having an elastic stick top and a coil spring middle. FIG. 9H is a diagram of a stick sensor configuration having a threaded cylinder bottom and elastic stick middle a coiled spring middle and a brush top with intermediate elastic stick between the brush top and coil spring. FIG. 9I is a diagram of a stick sensor configuration with a threaded cylinder bottom, an elastic stick above the threaded cylinder, a coiled spring above the elastic stick and brush material extending from the coiled spring.

Each of the different stick sensor configurations can be used in the present invention. The elastic stick bottom can be mounted directly in the base 40. The cylinder and cone bottom can form a spike for inserting into ground. The threaded cylinder can be threadedly connected to the base 40. An alternate embodiment for the stick sensor bottom connection is to connect the stick bottom, or the threaded cylinder to a ball joint installed in the base 40. The ball joint receives a degree of motion for maintaining the stick sensor in prone position when struck so that the user can see the path of the golf club head.

FIG. 10A-B shows a top view of the present invention. The ball is mounted to a shaft axis 110 which has a horizontal stop bar 226 forming a rotational range indicator 112. The rotation stopper 98 is a vertical shaft stopping the rotation of the rotational range indicator 112. Rotational stick sensors comprise a third rotational stick sensor 93, and a fourth rotational stick sensor 94. The rotational range indicator 112 provides an indication of the strength of the impact between the lower ball which is the target and the club head. Supplemental rotational stick sensors can also be mounted in parallel so that a second rotational stick sensor 92 can be mounted in front of the ball target, with a first rotational stick sensor 91 further behind the second rotational stick sensor 92 in front of the ball target. The club head speed can be calculated from the time differential between the activation of the different stick sensors among the rotational stick sensors. As stated before, the stick sensors at the striking row 80 include an outside stick sensor 82 and an inside stick sensor 81. The first striking row 50 includes a first row first stick sensor 51, a first row second stick sensor 52, a first row third stick sensor 53, and a first row fourth stick sensor 54. The time differential between the stick sensors can be used by the processor for modeling ball speed, ball path and other parameters. The brush and coil spring style stick means 113 for measuring rotational speed of the rotational range indicator is the preferred method.

FIG. 10B provides an electronic version of the stick sensor embodiment. The rotation range indicator 112 remains mechanical and the rotation stopper 98 also remains mechanical, however the position sensors for measuring rotation speed are substituted with electronic beam sensors that sense position similar to the stick sensor. A first position sensor 191 and a second position sensor 192 in conjunction with a third position sensor 193 with a fourth position sensor 194 provide input to a processor for determining the strength and speed of the club strike on the ball. Striking row inside position sensor 181 and striking row outside position sensor 182 can be mechanical or electronic. The preferred embodiment is to have a mechanical stick sensor configuration for the inside position sensor 81 and the outside position sensor 82 so that a user may strike the ball and see the stick sensor immediately afterwards. On the other hand, it is also possible to have an electronic embodiment of the inside position sensor 181 and the outside position sensor 182.

A pair of first row position sensors for club head path tracking 150 may comprise a first row inside position sensor 151 and a first row outside position sensor 152. The position sensors for tracking the club path may include a second row of position sensors including second row inside position sensor 161 and a second row outside position sensor 162.

The apparatus is primarily an input device, but can also function in conjunction with virtual golf accessories, such as console games. The input device can be an input device for a personal computer or console game. The input device can also be a standalone apparatus having simple visual or audio feedback such as tones or blinking lights which may or may not be used with virtual golf games.

The foregoing describes the preferred embodiments of the invention. Modifications may be made without departing from the spirit and scope of the invention as set forth in the following claims. The present invention is not limited to the embodiments described above, but encompasses any and all embodiments within the scope of the following claims.

The invention claimed is:

1. A golf swing modeling device comprising:

a. a base having a striking row of stick sensors; wherein stick sensors output individual signals, wherein the striking row of stick sensors comprises a striking row inside stick sensor and a striking row outside stick sensor;

b. a ball striking assembly having a ball mounted on a ball arm which is mounted on a retainer, wherein a striking face of the ball is placed between the striking row inside stick sensor and striking row outside stick sensor;

c. a processor receiving individual signals from the stick sensors, wherein the processor calculates club speed, and club head orientation from the individual signals, wherein the processor provides an output, wherein the distal row of stick sensors and the striking row of stick sensors are vertically oriented, wherein at least one of the stick sensors has a helical spring middle section.

2. The golf swing modeling device of claim 1, further comprising:

a. a distal row of stick sensors behind the striking row of stick sensors, wherein the distal row of stick sensors receives an input from a user's club.

3. A golf swing modeling device comprising:

a. a base having a striking row of stick sensors; wherein stick sensors output individual signals, wherein the striking row of stick sensors comprises a striking row inside stick sensor and a striking row outside stick sensor;

b. a ball striking assembly having a ball mounted on a ball arm which is mounted on a retainer, wherein a striking face of the ball is placed between the striking row inside stick sensor and striking row outside stick sensor;

c. a processor receiving individual signals from the stick sensors, wherein the processor calculates club speed, and club head orientation from the individual signals, wherein the processor provides an output;

d. wherein the distal row of stick sensors receives an input from a user's club, wherein the distal row of stick sensors and the striking row of stick sensors are vertically oriented, wherein at least one of the stick sensors has a multiple bristle brush top section.

4. The golf swing modeling device of claim 3, further comprising:

a. a distal row of stick sensors behind the striking row of stick sensors, wherein the distal row of stick sensors receives an input from a user's club.

5. A golf swing modeling device comprising:

a. a base having a striking row of stick sensors; wherein stick sensors output individual signals, wherein the striking row of stick sensors comprises a striking row inside stick sensor and a striking row outside stick sensor;

b. a ball striking assembly having a ball mounted on a ball arm which is mounted on a retainer, wherein a striking face of the ball is placed between the striking row inside stick sensor and striking row outside stick sensor;

c. a processor receiving individual signals from the stick sensors, wherein the processor calculates club speed, and club head orientation from the individual signals, wherein the processor provides an output; and d. a third row of sensors which includes a third row first sensor, a third row second sensor, a third row third sensor, a third row fourth sensor, a third row fifth sensor, a third row sixth sensor, a third row seventh sensor, and finally a third row eighth sensor, further comprising a third row of sockets, wherein the third row of sensors is mounted within the third row of sockets so that the base of the sensors in the third row of sensors is retained within the third row of sockets, and further comprising a protective slope.

6. The golf swing modeling device of claim 5, further comprising:

a. a distal row of stick sensors behind the striking row of stick sensors, wherein the distal row of stick sensors receives an input from a user's club.

* * * * *